US010940705B2

(12) United States Patent
Yoshida et al.

(10) Patent No.: US 10,940,705 B2
(45) Date of Patent: Mar. 9, 2021

(54) BASE MATERIAL PROCESSING APPARATUS AND DETECTION METHOD

(71) Applicant: SCREEN HOLDINGS CO., LTD., Kyoto (JP)

(72) Inventors: Mitsuhiro Yoshida, Kyoto (JP); Kazuki Fukui, Kyoto (JP); Katsuyuki Hisaoka, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 29 days.

(21) Appl. No.: 16/552,616

(22) Filed: Aug. 27, 2019

(65) Prior Publication Data

US 2020/0094590 A1 Mar. 26, 2020

(30) Foreign Application Priority Data

Sep. 20, 2018 (JP) ..... 2018-176425

(51) Int. Cl.
*B41J 13/00* (2006.01)

(52) U.S. Cl.
CPC ..... *B41J 13/0009* (2013.01)

(58) Field of Classification Search
CPC ..... B41J 13/0009
See application file for complete search history.

(56) References Cited

U.S. PATENT DOCUMENTS

2003/0116042 A1 6/2003 Ohba et al.
2008/0122889 A1 5/2008 Naoi et al.
2012/0240803 A1* 9/2012 Sato et al. ..... B41J 11/0015
2015/0009256 A1 1/2015 Bildstein et al.
2016/0075155 A1 3/2016 Fukui et al.

FOREIGN PATENT DOCUMENTS

EP 3 275 676 A1 1/2018
JP 2016-055570 A 4/2016

OTHER PUBLICATIONS

Extended European Search Report issued in corresponding European Patent Application No. 19193646.7-1017, dated Feb. 14, 2020.

* cited by examiner

*Primary Examiner* — Juanita D Jackson
(74) *Attorney, Agent, or Firm* — McDermott Will & Emery LLP

(57) ABSTRACT

A displacement amount calculation part in a base material processing apparatus calculates the degree of matching between an upstream data section and a downstream data section included in a first and a second detection results, which indicate time-varying changes in the positions of an edge of a base material in the width direction at an upstream and a downstream detection positions. This calculation uses calculation results obtained by sequentially calculating the degrees of matching between sub-data sections in the upstream data section and downstream sub-data sections in the downstream data section. This reduces the amount of computation and enables highly accurate detection of the amount of displacement of the base material in the transport direction on the basis of an identification result of the downstream data section that is highly matched with the upstream data section.

16 Claims, 10 Drawing Sheets

BASE MATERIAL PROCESSING APPARATUS AND DETECTION METHOD

RELATED APPLICATIONS

This application claims the benefit of Japanese Application No. 2018-176425, filed on Sep. 20, 2018, the disclosure of which is incorporated by reference herein.

BACKGROUND OF THE INVENTION

Field of the Invention

The present invention relates to a technique for use in a base material processing apparatus that processes a long band-like base material while transporting the base material, and for detecting the amount of displacement of the base material in the transport direction or the amount of difference in the transport speed of the base material.

Description of the Background Art

There have conventionally been known inkjet image recording apparatuses that record a multicolor image on long band-like printing paper by ejecting ink from a plurality of recording heads while transporting the printing paper in a longitudinal direction of the paper. The image recording apparatuses eject ink of different colors from the heads. Then, single-color images formed by each color ink are superimposed on one another so that a multicolor image is recorded on a surface of the printing paper. One example of the conventional image recording apparatuses is described in, for example, Japanese Patent Application Laid-Open No. 2016-55570.

This type of image recording apparatuses are designed to transport printing paper at a constant speed with a plurality of rollers. However, the transport speed of the printing paper under the recording heads may differ from an ideal transport speed due to skids occurring between the surface of each roller and the printing paper or due to elongation of the printing paper caused by the ink. This causes the ejection position of each color ink to be displaced in the transport direction on the surface of the printing paper, thereby causing mutual misregistration of the single-color images.

In order to suppress such mutual misregistration of the single-color images, reference images such as register marks have conventionally been formed on the surface of the printing paper. The image recording apparatuses detect the positions of the reference images and correct the ejection position of ink from each recording head on the basis of detection results. The reference images are, however, formed at predetermined intervals in the transport direction of the printing paper. Thus, it is difficult to successively detect displacement of the printing paper on the basis of the reference images. Besides, the reference images formed on the surface of the printing paper narrows the space for recording an intended print image.

Thus, there is demand for a technique that enables detection of the amount of displacement of the printing paper in the transport direction or the amount of difference in the transport speed of the printing paper without depending on reference images such as register marks. However, in order for the image recording apparatuses to perform real-time correction of the aforementioned mutual misregistration of the signal-color images, it is desirable to minimize the amount of computation required to detect the amount of displacement of the printing paper in the transport direction or the amount of difference in the transport speed of the printing paper so as to speed up the detection processing.

SUMMARY OF THE INVENTION

It is an object of the present invention to provide a technique for use in a base material processing apparatus that processes a long band-like base material while transporting the base material in a longitudinal direction, and for detecting the amount of displacement of the base material in the transport direction or the amount of difference in the transport speed of the base material with high accuracy without depending on images such as register marks formed on the surface of the base material and while reducing the amount of computation performed by a controller.

To solve the problems described above, a first aspect of the present invention is a base material processing apparatus that includes a transport mechanism that transports a long band-like base material in a longitudinal direction along a predetermined transport path, a first detector that successively or intermittently detects a position of an edge of the base material in a width direction at an upstream detection position in the transport path to acquire a first detection result, a second detector that successively or intermittently detects the position of the edge of the base material in the width direction at a downstream detection position located downstream of the upstream detection position in the transport path to acquire a second detection result, and a displacement amount calculation part that, for each of a plurality of upstream data sections that are data sections included in the first detection result, identifies a highly matched downstream data section from among a plurality of downstream data sections that are data sections included in the second detection result, and calculates an amount of displacement of the base material in a transport direction or an amount of difference in a transport speed of the base material on the basis of an identification result. Each of the plurality of upstream data sections includes a plurality of upstream sub-data sections, each of the plurality of downstream data sections includes a plurality of downstream sub-data sections, and the displacement amount calculation part uses at least one result obtained by sequentially calculating a degree of matching between one of the plurality of upstream sub-data sections and one of the plurality of downstream sub-data sections to identify the highly matched downstream data section for each of the plurality of upstream data sections.

A second aspect of the present invention is a detection method of detecting an amount of displacement of a long band-like base material in a transport direction or an amount of difference in a transport speed of the base material while transporting the base material in a longitudinal direction along a predetermined transport path. The detection method includes a) successively or intermittently detecting a position of an edge of the base material in a width direction at an upstream detection position in the transport path to acquire a first detection result, b) successively or intermittently detecting the position of the edge of the base material in the width direction at a downstream detection position located downstream of the upstream detection position in the transport path to acquire a second detection result, and c) for each of a plurality of upstream data sections that are data sections included in the first detection result, identifying a highly matched downstream data section from among a plurality of downstream data sections that are data sections included in the second detection result, and calculating the amount of displacement of the base material in the transport direction or the amount of difference in the transport speed of the base material on the basis of an identification result. Each of the plurality of upstream data sections includes a plurality of upstream sub-data sections, each of the plurality of downstream data sections includes a plurality of downstream sub-data sections, and in the operation c), at least one result obtained by sequentially calculating a degree of matching between one of the plurality of upstream sub-data sections and one of the plurality of downstream sub-data sections is used to identify the highly matched downstream data section for each of the plurality of upstream data sections.

According to the first and second aspects of the present invention, a downstream data section that is highly matched with an upstream data section can be identified efficiently by selecting and using the results obtained by successively calculating the degree of matching between each upstream sub-data section included in the upstream data section and each downstream sub-data section included in the downstream data section. This enables highly accurate detection of the amount of displacement of the base material in the transport direction or the amount of difference in the transport speed of the base material while reducing the amount of computation performed by the displacement amount calculation part.

These and other objects, features, aspects and advantages of the present invention will become more apparent from the following detailed description of the present invention when taken in conjunction with the accompanying drawings.

DESCRIPTION OF PREFERRED EMBODIMENTS

Embodiments of the present invention will be described hereinafter with reference to the drawings.

1. First Embodiment

1-1. Configuration of Image Recording Apparatus

Figure 1:
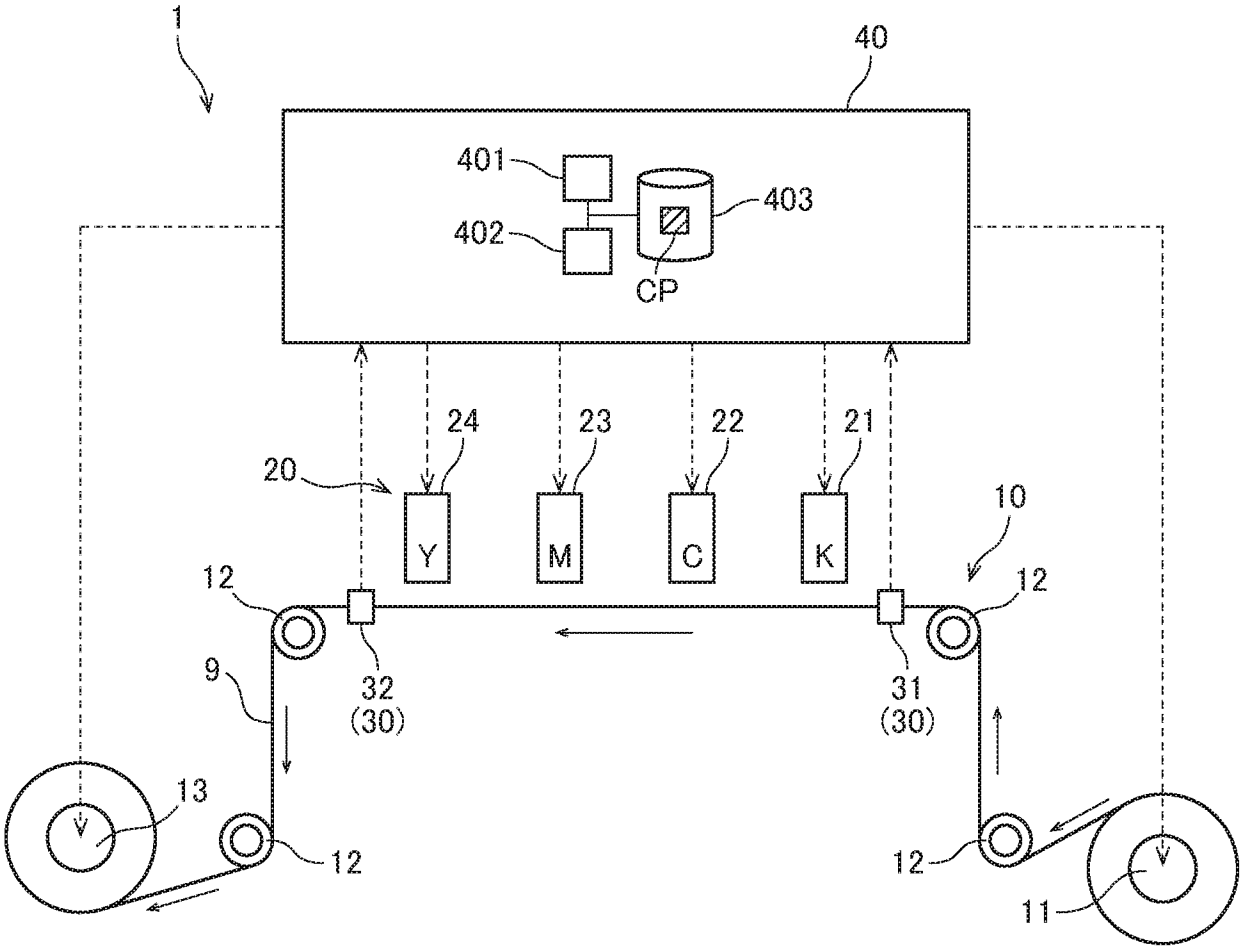
FIG. 1 illustrates a configuration of an image recording apparatus according to a first embodiment.

FIG. 1 illustrates a configuration of an image recording apparatus 1 as one example of a base material processing apparatus according to a first embodiment of the present invention. The image recording apparatus 1 is an inkjet printing apparatus that records a multicolor image on printing paper 9, which is a long band-like base material, by ejecting ink from a plurality of recording heads 21 to 24 toward the printing paper 9 while transporting the printing paper 9. As illustrated in FIG. 1, the image recording apparatus 1 includes a transport mechanism 10, an image recording part 20, two edge sensors 30, and a controller 40.

The transport mechanism 10 is a mechanism for transporting the printing paper 9 in a transport direction that is along the longitudinal direction of the printing paper 9. The transport mechanism 10 according to the present embodiment includes a plurality of rollers including a feed roller 11, a plurality of transport rollers 12, and a take-up roller 13. The printing paper 9 is fed from the feed roller 11 and transported along a predetermined transport path configured by the plurality of transport rollers 12. Each transport roller 12 rotates about a horizontal axis so as to guide the printing paper 9 downstream of the transport path. The transported printing paper 9 is collected by the take-up roller 13. These rollers are rotationally driven by a drive part 45 of the controller 40, which will be described later.

As illustrated in FIG. 1, the printing paper 9 travels in approximately parallel with the direction of arrangement of the plurality of recording heads 21 to 24 under the recording heads 21 to 24. At this time, the record surface (front surface) of the printing paper 9 faces upward (i.e., faces the recording heads 21 to 24). The printing paper 9 runs under tension over the plurality of transport rollers 12. This configuration suppresses the occurrence of slack or creases in the printing paper 9 during transport.

The image recording part 20 is a processing part that ejects ink droplets to the printing paper 9 that is being transported by the transport mechanism 10. The image recording part 20 according to the present embodiment includes the first recording head 21, the second recording head 22, the third recording head 23, and the fourth recording head 24. The first, second, third, and fourth recording heads 21, 22, 23, and 24 are arranged along the transport path of the printing paper 9.

Figure 2:
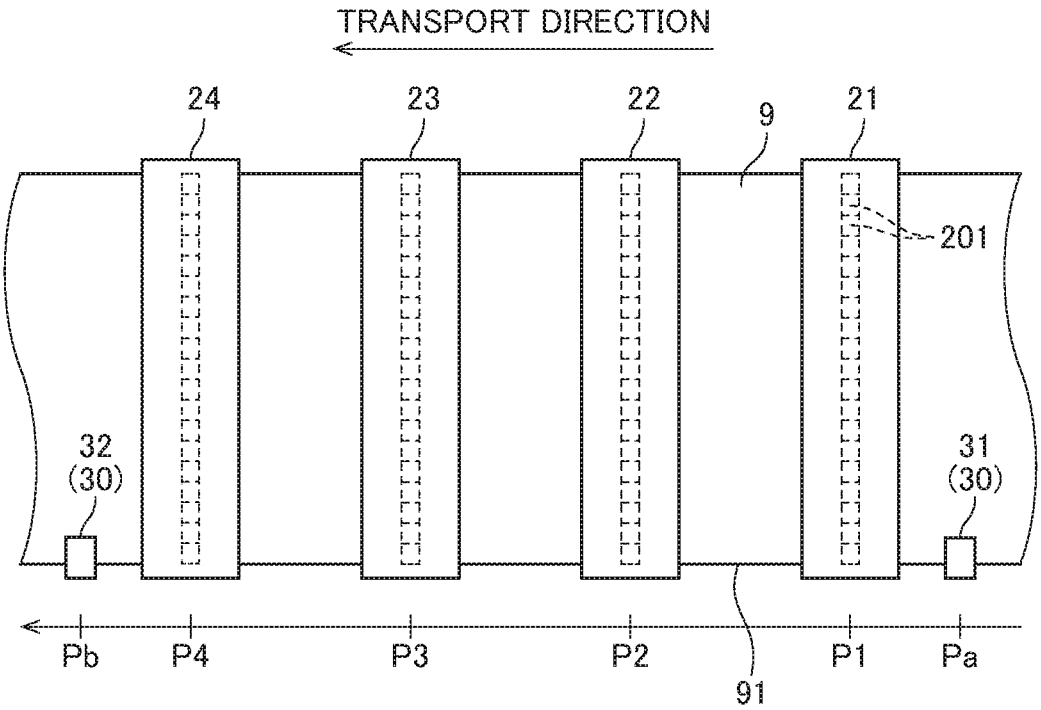
FIG. 2 is a partial top view of the image recording apparatus in the proximity of an image recording part according to the first embodiment.

FIG. 2 is a partial top view of the image recording apparatus 1 in the proximity of the image recording part 20. The four recording heads 21 to 24 each cover the overall dimension of the printing paper 9 in the width direction (i.e., the horizontal direction which is also orthogonal to the transport direction). As indicated by broken lines in FIG. 2, each of the recording heads 21 to 24 has a lower surface provided with a plurality of nozzles 201 aligned in parallel with the width direction of the printing paper 9. The recording heads 21 to 24 respectively eject black (K), cyan (C), magenta (M), and yellow (Y) ink droplets, which are color components of a multicolor image, from their nozzles 201 toward the upper surface of the printing paper 9.

That is, the first recording head 21 ejects black ink droplets to the upper surface of the printing paper 9 at a first processing position P1 in the transport path. The second recording head 22 ejects cyan ink droplets to the upper surface of the printing paper 9 at a second processing position P2 that is located downstream of the first processing position P1. The third recording head 23 ejects magenta ink droplets to the upper surface of the printing paper 9 at a third processing position P3 that is located downstream of the second processing position P2. The fourth recording head 24 ejects yellow ink droplets to the upper surface of the printing paper 9 at a fourth processing position P4 that is located downstream of the third processing position P3. In the present embodiment, the first, second, third, and fourth processing positions P1, P2, P3, and P4 are aligned at equal intervals in the transport direction of the printing paper 9.

The four recording heads 21 to 24 each eject ink droplets so as to record a single-color image on the upper surface of the printing paper 9. Then, the four single-color images are superimposed on one another so that a multicolor image is formed on the upper surface of the printing paper 9. If the positions of ejection of ink droplets from the four recording heads 21 to 24 are displaced from one another in the transport direction on the printing paper 9, the image quality of printed matter will deteriorate. Thus, controlling such mutual misregistration of the single-color images on the printing paper 9 to fall within tolerance is an important factor for improving the print quality of the image recording apparatus 1.

Note that a dry processing part for drying the ink ejected to the record surface of the printing paper 9 may additionally be provided downstream of the recording heads 21 to 24 in the transport direction. The dry processing part is, for example, configured to dry ink by blowing heated gas toward the printing paper 9 and vaporizing a solvent in the ink that adheres to the printing paper 9. The dry processing part may, however, dry ink by other methods, such as with heating rollers or by photoirradiation.

The two edge sensors 30 serve as detectors that detect the position of an edge 91 (end in the width direction) of the printing paper 9 in the width direction. In the present embodiment, the edge sensors 30 are disposed at an upstream detection position Pa located upstream of the first processing position P1 in the transport path and at a downstream detection position Pb located downstream of the fourth processing position P4.

Figure 3:
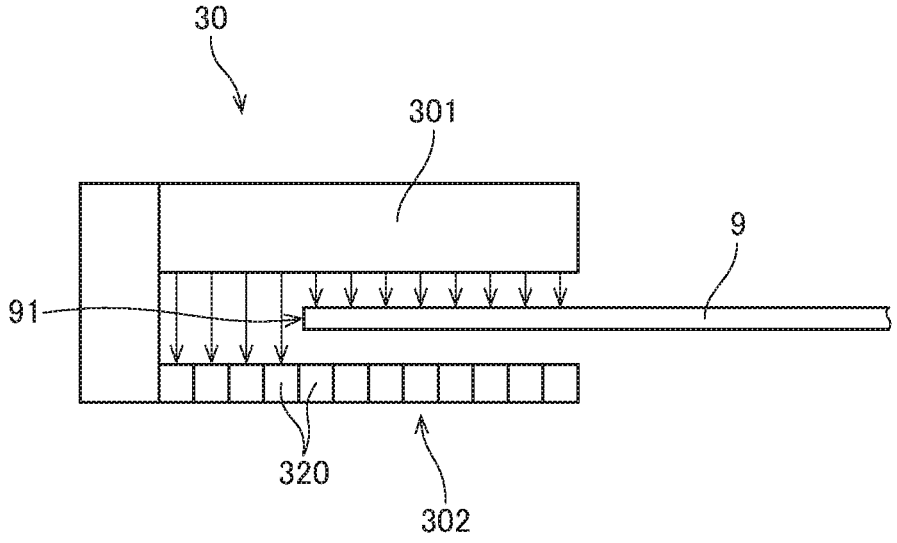
FIG. 3 schematically illustrates a structure of an edge sensor according to the first embodiment.

FIG. 3 schematically illustrates a structure of each edge sensor 30. As illustrated in FIG. 3, the edge sensors 30 each include a projector 301 that is located above the edge 91 of the printing paper 9, and a line sensor 302 that is located below the edge 91. The projector 301 emits parallel light downward. The line sensor 302 includes a plurality of light receiving elements 320 aligned in the width direction. As illustrated in FIG. 3, outside of the edge 91 of the printing paper 9, the light emitted from the projector 301 enters the light receiving elements 320, and the light receiving elements 320 detect that light. On the other hand, inside of the edge 91 of the printing paper 9, the light emitted from the projector 301 is blocked by the printing paper 9, and therefore the light receiving elements 320 do not detect that light. The edge sensors 30 detect the position of the edge 91 of the printing paper 9 in the width direction on the basis of whether the light has been detected by the light receiving elements 320.

As illustrated in FIGS. 1 and 2, the edge sensor 30 disposed at the upstream detection position Pa is hereinafter referred to as a "first edge sensor 31." Also, the edge sensor 30 disposed at the downstream detection position Pb is referred to as a "second edge sensor 32." The first edge sensor 31 is one example of a "first detector" according to the present invention. The first edge sensor 31 intermittently detects the position of the edge 91 of the printing paper 9 in the width direction at the upstream detection position Pa. Thereby, the first edge sensor 31 acquires a detection result (hereinafter, referred to as a "first detection result R1") that indicates a time-varying change in the position of the edge 91 in the width direction at the upstream detection position Pa. The first edge sensor 31 then outputs a detection signal indicating the acquired first detection result R1 to the controller 40. The second edge sensor 32 is one example of a "second detector" according to the present invention. The second edge sensor 32 intermittently detects the position of the edge 91 of the printing paper 9 in the width direction at the downstream detection position Pb. Thereby, the second edge sensor 32 acquires a detection result (hereinafter, referred to as a "second detection result R2") that indicates a time-varying change in the position of the edge 91 in the width direction at the downstream detection position Pb. The second edge sensor 32 then outputs a detection signal indicating the acquired second detection result R2 to the controller 40.

The controller 40 controls operations of each part of the image recording apparatus 1. As schematically illustrated in FIG. 1, the controller 40 is configured by a computer that includes a processor 401 such as a CPU, a memory 402 such as a RAM, and a storage device 403 such as a hard disk drive. The storage device 403 stores a computer program CP for executing print processing. As indicated by broken lines in FIG. 1, the controller 40 is electrically connected to each of the transport mechanism 10, the four recording heads 21 to 24, and the two edge sensors 30, which have been described above. The controller 40 controls operations of these parts in accordance with the computer program CP. In this way, print processing proceeds in the image recording apparatus 1.

1-2. Detection and Correction Processing

In the case of executing print processing, the controller 40 acquires the detection signal indicating the first detection result R1 from the first edge sensor 31 and acquires the detection signal indicating the second detection result R2 from the second edge sensor 32. The controller 40 then detects the amount of displacement of the printing paper 9 in the transport direction on the basis of the acquired detection signals. The controller 40 also corrects the timing of ejection of ink droplets from the four recording heads 21 to 24 on the basis of the detected amount of displacement. This suppresses the aforementioned mutual misregistration of the single-color images.

Figure 4:
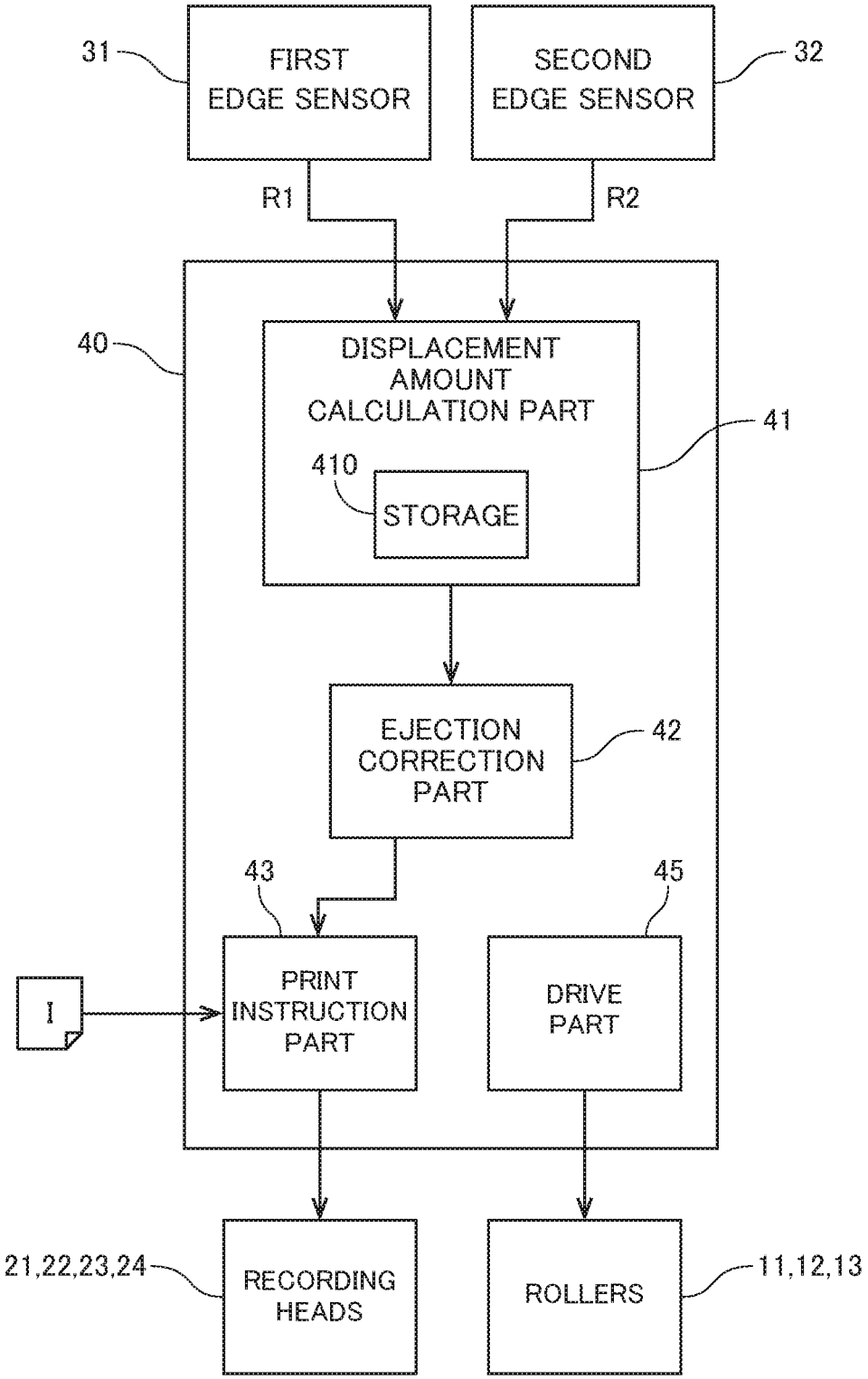
FIG. 4 is a block diagram schematically illustrating functions of a controller according to the first embodiment.

FIG. 4 is a block diagram schematically illustrating functions of the controller 40 for implementing the detection and correction processing. As illustrated in FIG. 4, the controller 40 includes a displacement amount calculation part 41, an ejection correction part 42, a print instruction part 43, and the drive part 45. The functions of the displacement amount calculation part 41, the ejection correction part 42, the print instruction part 43, and the drive part 45 are implemented by the processor 401 operating in accordance with the computer program CP. Note that the displacement amount calculation part 41, the ejection correction part 42, the print instruction part 43, and the drive part 45 may be implemented by dedicated circuits such as FPGAs. The drive part 45 rotationally drives at least one of the plurality of rollers including the feed roller 11, the plurality of transport rollers 12, and the take-up roller 13 at a constant rotation speed, so that the printing paper 9 is transported along the transport path.

The displacement amount calculation part 41 calculates the amount of displacement of the printing paper 9 in the transport direction on the basis of the first detection result R1 obtained from the first edge sensor 31 and the second detection result R2 obtained from the second edge sensor 32. Note that the displacement amount calculation part 41 includes a storage 410 that temporarily stores the detection signal acquired from the first edge sensor 31 and indicating the first detection result R1 and the detection signal acquired from the second edge sensor 32 and indicating the second detection result R2. The function of the storage 410 is implemented by, for example, the memory 402 or the storage device 403 described above. The displacement amount calculation part 41 executes each processing while reading out the detection signal indicating the first detection result R1 and the detection indicating the second detection result R2 from the storage 410.

Figure 5A:
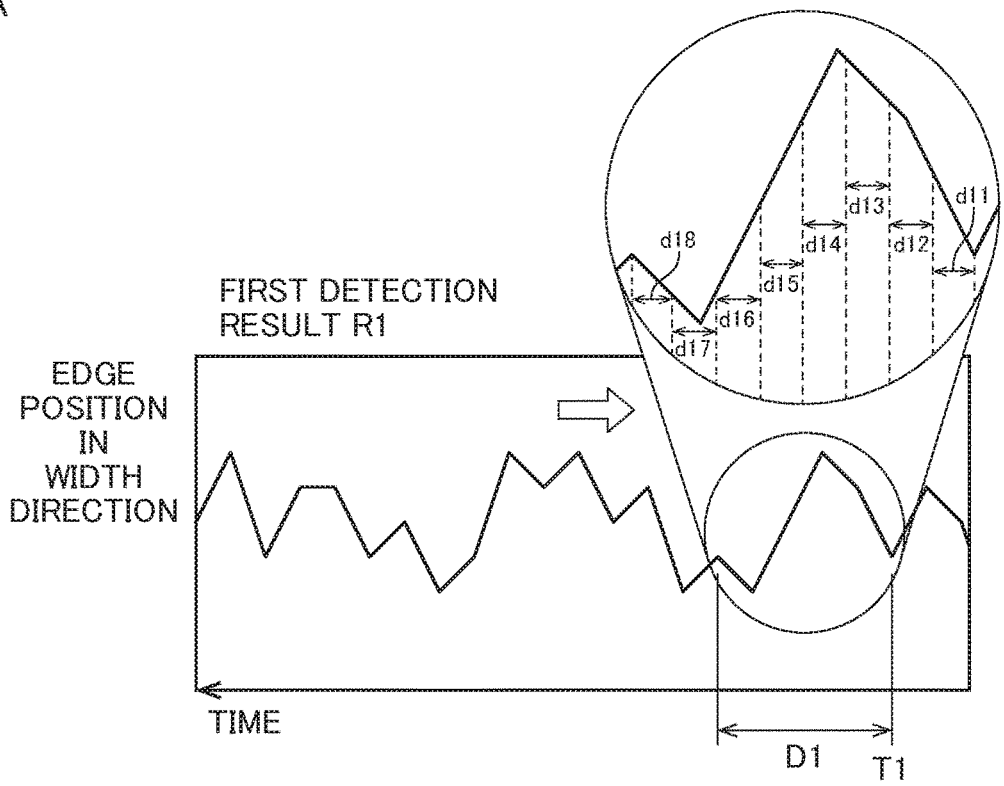
FIG. 5A is a graph showing an example of a first detection result according to the first embodiment.
Figure 5B:
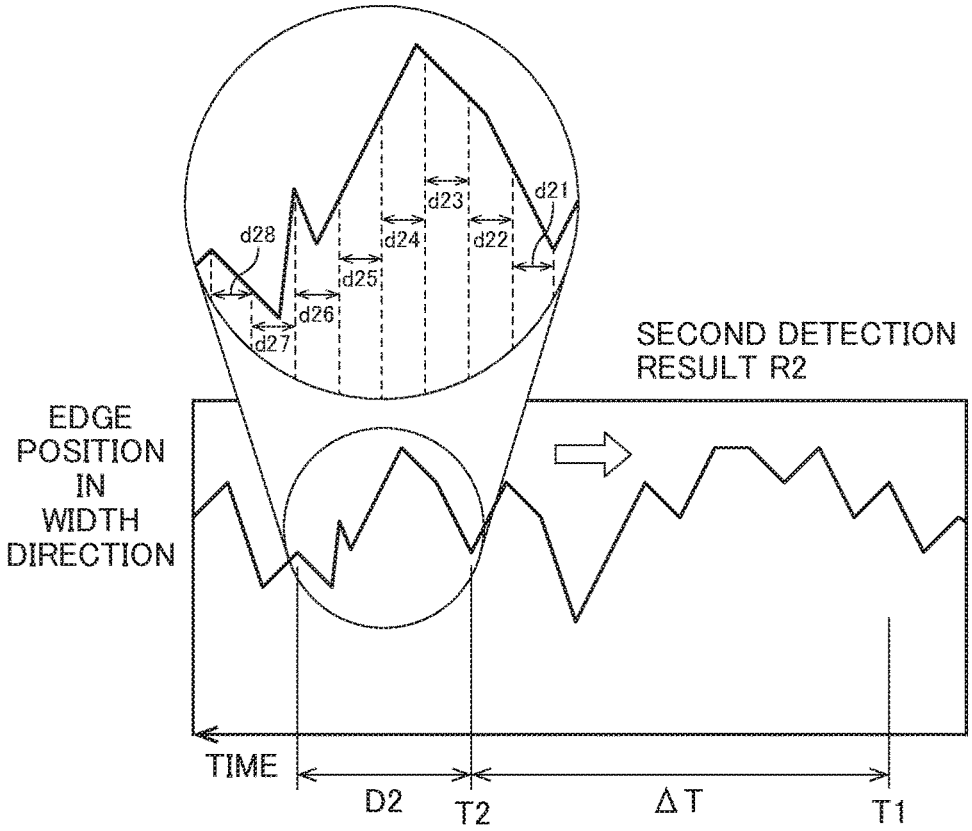
FIG. 5B is a graph showing an example of a second detection result according to the first embodiment.

FIG. 5A is a graph showing an example of the first detection result R1. FIG. 5B is a graph showing an example of the second detection result R2. In the graphs in FIGS. 5A and 5B, the horizontal axis represents time, and the vertical axis represents the position of the edge 91 in the width direction. Note that the left end of the horizontal axis of the graphs in FIGS. 5A and 5B represents current time, and the time gets earlier as the distance to the right from the left end increases. Thus, the data lines in FIGS. 5A and 5B move to the right with the passage of time, as indicated by hollow arrows. Accordingly, for example, a value at the right end of the data line in FIG. 5A indicates the position of the edge 91 in the width direction of a portion of the printing paper 9 that has passed through the first edge sensor 31 at the earliest time in the data line in FIG. 5A. Also, the value at the right end of the data line in FIG. 5B indicates the position of the edge 91 in the width direction of a portion of the printing paper 9 that has passed through the second edge sensor 32 at the earliest time in the data line in FIG. 5B.

The edge 91 of the printing paper 9 has fine irregularities. The first edge sensor 31 and the second edge sensor 32 detect the position of the edge 91 of the printing paper 9 in the width direction at pre-set considerably short time intervals (e.g., every 50 μsec). Thereby, the edge sensors acquire data that indicates a time-varying change in the position of the edge 91 of the printing paper 9 in the width direction as illustrated in FIGS. 5A and 5B. The first detection result R1 illustrated in FIG. 5A is data that reflects the shape of the edge 91 of the printing paper 9 that passes through the upstream detection position Pa. The second detection result R2 illustrated in FIG. 5B is data that reflects the shape of the edge 91 of the printing paper 9 that passes through the downstream detection position Pb.

To calculate the amount of displacement of the printing paper 9 in the transport direction, the displacement amount calculation part 41 first compares the first detection result R1 and the second detection result R2. Then, the displacement amount calculation part 41 identifies portions where the same edge 91 of the printing paper 9 has been detected in the first detection result R1 and the second detection result R2. Specifically, for each data section (a given range of time) included in the first detection result R1, the displacement amount calculation part 41 identifies a highly matched data section from among a plurality of data sections (given ranges of time) included in the second detection result R2. Hereinafter, each data section included in the first detection result R1 is referred to as an "upstream data section D1." Also, each data section included in the second detection result R2 is referred to as a "downstream data section D2." That is, for each upstream data section D1 included in the first detection result R1, the displacement amount calculation part 41 selects a plurality of downstream data sections D2 included in the second detection result R2 as candidates for the corresponding data section, and then identifies a most highly matched downstream data section from among the plurality of selected candidates.

Figure 6:
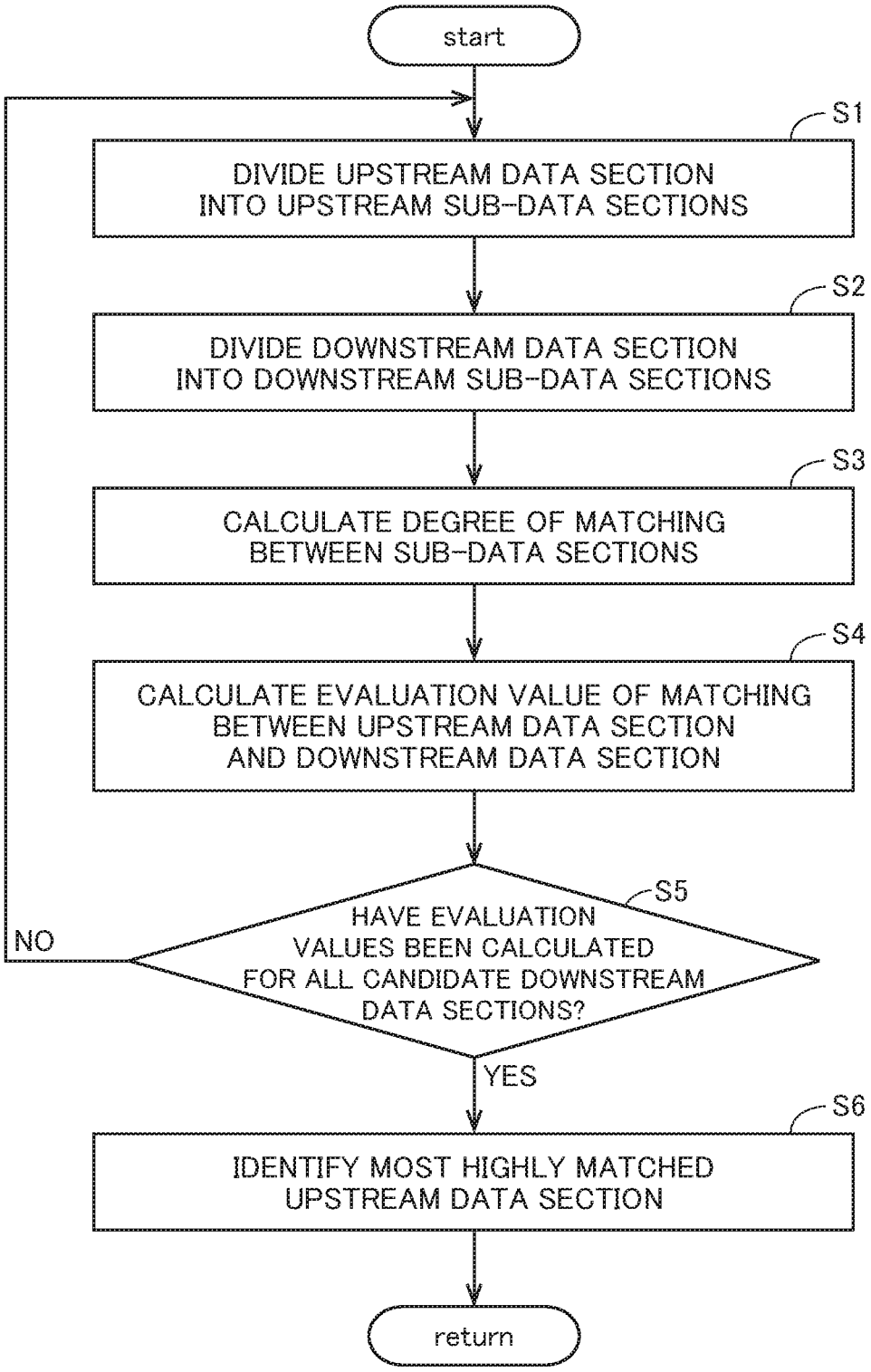
FIG. 6 is a flowchart showing a procedure for identifying a downstream data section that is highly matched with an upstream data section.

Hereinafter, a method of identifying a highly matched downstream data section D2 for each upstream data section D1 will be described in further detail with reference to the flowchart in FIG. 6. First, the displacement amount calculation part 41 divides the upstream data section D1 into a plurality of (in the present embodiment, eight) upstream sub-data sections d11 to d18 (see the enlarged view in FIG. 5A) (step S1). The displacement amount calculation part 41 also divides a downstream data section D2 that is one of the candidates for the data section corresponding to the upstream data section D1 into the same number of (in the present embodiment, eight) downstream sub-data sections d21 to d28 as the number of upstream sub-data sections (see the enlarged view in FIG. 5B) (step S2). The upstream sub-data sections d11 to d18 have the same breadth, and the downstream sub-data sections d21 to d28 have the same breadth. Note that the number of upstream sub-data sections into which each upstream data section D1 is divided, and the number of downstream sub-data sections into which each downstream data section D2 is divided may be in the range of two to seven or may be nine or more.

Figure 7:
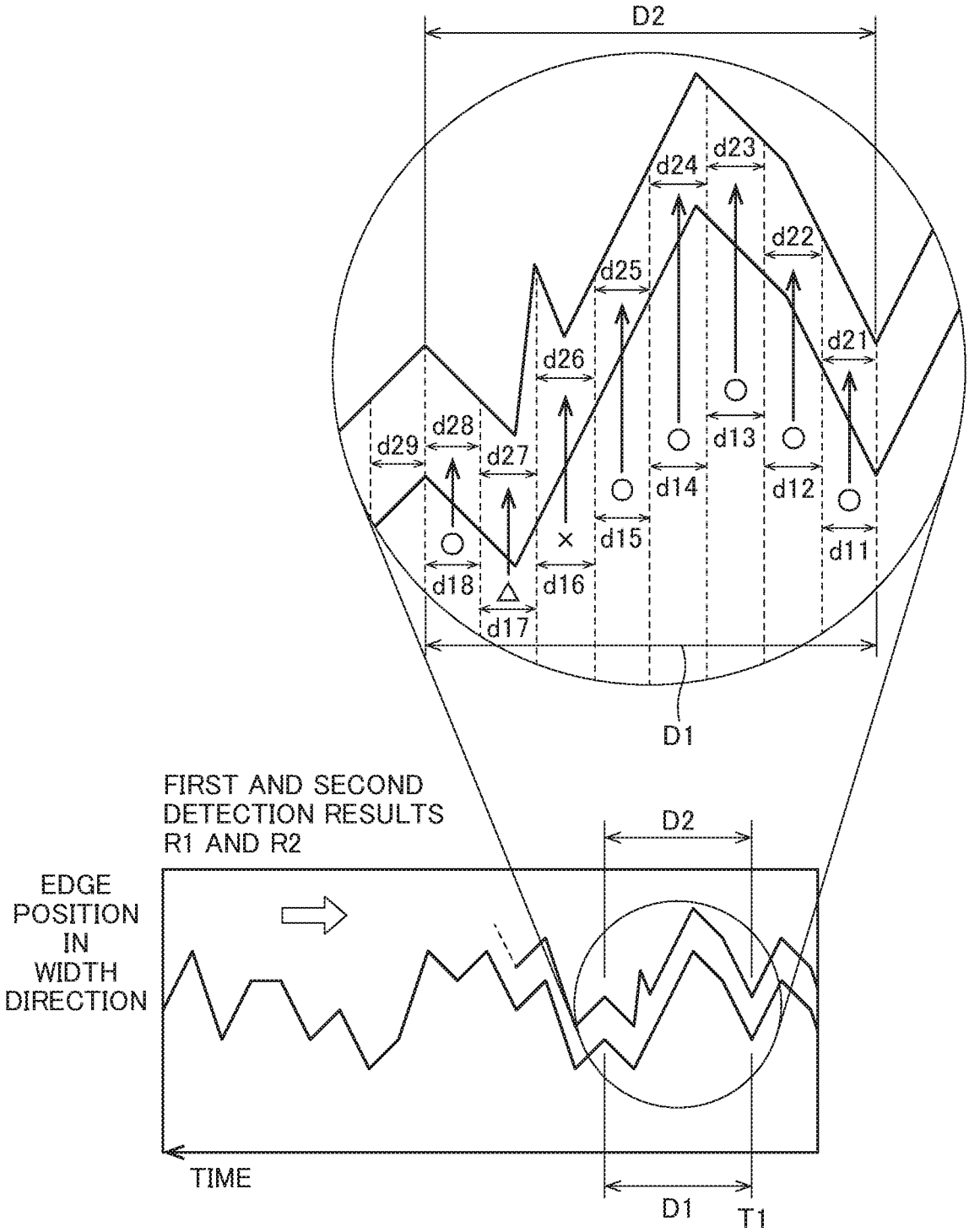
FIG. 7 is a graph obtained by overlaying the example of the first detection result and the example of the second detection result according to the first embodiment.

FIG. 7 is a graph obtained by overlaying the example of the first detection result R1 and the example of the second detection result R2. In FIG. 7, the graph of the second detection result R2 is overlaid and displayed on the graph of the first detection result R1 after having been moved such that a detection time T2 of the aforementioned downstream data section D2, which is one of the candidates for the data section corresponding to the upstream data section D1, is made coincide with a detection time T1 of the upstream data section D1.

As illustrated in FIG. 7, the displacement amount calculation part 41 then sequentially calculates the degree of matching between one of the upstream sub-data sections d11 to d18 included in the upstream data section D1 and one of the downstream sub-data sections d21 to d28 included in the downstream data section D2 (step S3). Specifically, the displacement amount calculation part 41 sequentially calculates the degree of matching between the upstream sub-data section d11 and the downstream sub-data section d21, the degree of matching between the upstream sub-data section d12 and the downstream sub-data section d22, . . . , the degree of matching between the upstream sub-data section d17 and the downstream sub-data section d27, and the degree of matching between the upstream sub-data section d18 and the downstream sub-data section d28. For example, a matching technique such as cross-correlation or residual sum of squares is used to calculate the degree of matching between one of the upstream sub-data sections and one of the downstream sub-data sections.

Then, the displacement amount calculation part 41 calculates an evaluation value that indicates the degree of matching between the upstream data section D1 and the downstream data section D2 by, for example, finding an average or total value of results (in the present embodiment, eight calculation results) obtained by sequentially calculating the degree of matching between one of the upstream sub-data sections d1 to d18 and one of the downstream sub-data sections d21 to d28 (step S4). In this way, by using the calculation results of the degrees of matching between the upstream sub-data sections d11 to d18 smaller than the upstream data section D1 and the downstream sub-data sections d21 to d28 smaller than the downstream data section D2, it is possible to reduce the amount of data that is stored temporarily in the storage 410 for computation processing. It is also possible to reduce the amount of calculation required to evaluate the degree of matching and to thereby speed up the processing.

Note that the displacement amount calculation part 41 uses at least one of the eight calculation results obtained by sequentially calculating the degree of matching between one of the upstream sub-data sections d11 to d18 and one of the downstream sub-data sections d21 to d28 to calculate the evaluation value indicating the degree of matching between the upstream data section D1 and the downstream data section D2. That is, the displacement amount calculation part 41 may ignore poorly matched sub-data sections and use only the remaining sub-data sections to calculate the evaluation value because it is also possible to have a case in which an exceptional error occurs due to influences such as noise. For example, as illustrated in FIG. 7, assume the case in which six of the eight calculation results, excluding the calculation result of the degree of matching between the upstream sub-data section d16 and the downstream sub-data section d26 and the calculation result of the degree of matching between the upstream sub-data section d17 and the downstream sub-data section d27, show high degrees of matching. In this case, the displacement amount calculation part 41 may find, for example, an average or total value of these six calculation results to calculate the evaluation value indicating the degree of matching between the upstream data section D1 and the downstream data section D2. Alternatively, an evaluation value that indicates the degree of matching between the most highly matched sub-data sections may be determined as an evaluation value that indicates the degree of matching for the entire data section. In order to further improve accuracy, a matching calculation result distribution that shows, as a distribution, the calculation results of evaluation values indicating the degree of matching for each sub-data section may be determined as an evaluation value that indicates the degree of matching for the entire data section.

This further reduces the amount of computation performed by the displacement amount calculation part 41. As a result, as will be described later, it is possible to detect the amount of displacement of the printing paper 9 in the transport direction more quickly and to correct the timing of ejection of ink droplets from the four recording heads 21 to 24 more quickly on the basis of the detected amount of displacement. It is also possible to shorten the distance over which the printing paper 9 is transported during a period of time until the timing of ejection of ink droplets from the four recording heads 21 to 24 is corrected based on the detected amount of displacement. Moreover, even if the upstream data section D1 and the downstream data section D2 partly include noise generated by external factors, the evaluation value indicating the degree of matching between the upstream data section D1 and the downstream data section D2 can be calculated with high accuracy. Accordingly, it is possible to obtain a high-quality print image with less mutual misregistration of the single-color images.

As another alternative, in the case of sequentially calculating the degree of matching between one of the upstream sub-data sections d11 to d18 and one of the downstream sub-data sections d21 to d28, the displacement amount calculation part 41 may sequentially calculate the degree of matching between data that is obtained by filtering data about each of the upstream sub-data sections d11 to d18 and data that is obtained by filtering data about each of the downstream sub-data sections d21 to d28. That is, the displacement amount calculation part 41 may sequentially calculate the degree of matching between signals in a predetermined frequency band extracted from each of the upstream sub-data sections d11 to d18 and signals in the predetermined frequency band extracted from each of the downstream sub-data sections d21 to d28. Specifically, only signals in a frequency band that corresponds to the shape of the edge of the printing paper 9 may be extracted by removing signals in a low frequency band that corresponds meandering motion of the printing paper 9 and signals in a high frequency band that corresponds to the noise. By so doing, it is possible to calculate the evaluation value indicating the degree of matching between the upstream data section D1 and the downstream data section D2 with higher accuracy.

For each upstream data section D1, the displacement amount calculation part 41 calculates the evaluation value indicating the degree of matching between the upstream data section D1 and each of the plurality of downstream data sections D2, selected as candidates for the data section corresponding to the upstream data section D1, by the aforementioned method (i.e., repeats steps S1 to S5). Then, the displacement amount calculation part 41 identifies a downstream data section D2 that has a highest evaluation value among the plurality of downstream data sections D2, as the downstream data section D2 corresponding to the upstream data section D1 (where the same edge 91 has been detected) (step S6). Hereinafter, a specific description is given of processing for repeatedly calculating the evaluation value while shifting the downstream data section D2 that serves as a candidate.

First, a method is described for selecting a plurality of downstream data sections D2 as candidates for the data section corresponding to the upstream data section D1. In the following description, the "ideal transport time" is assumed to be a duration of time required to transport the printing paper 9 from the upstream detection position Pa to the downstream detection position Pb in the case where no skids occurs between the printing paper 9 and the surface of each roller of the transport mechanism 10 or no elongation of the printing paper 9 is caused by ink ejection. In this case, a time difference between the first detection result R1 and the second detection result R2 does not considerably differ from the ideal transport time required to transport the printing paper 9 from the upstream detection position Pa to the downstream detection position Pb. Thus, the displacement amount calculation part 41 may estimate a data section that appears around a time after the elapse of the ideal transport time since the upstream data section D1 to be the downstream data section D2 corresponding to the upstream data section D1, and may select a plurality of downstream data sections D2 that is located in close proximity to the estimated downstream data section D2 as candidates for the data section corresponding to the upstream data section D1. This narrows the range of search for the downstream data section D2.

Figure 8:
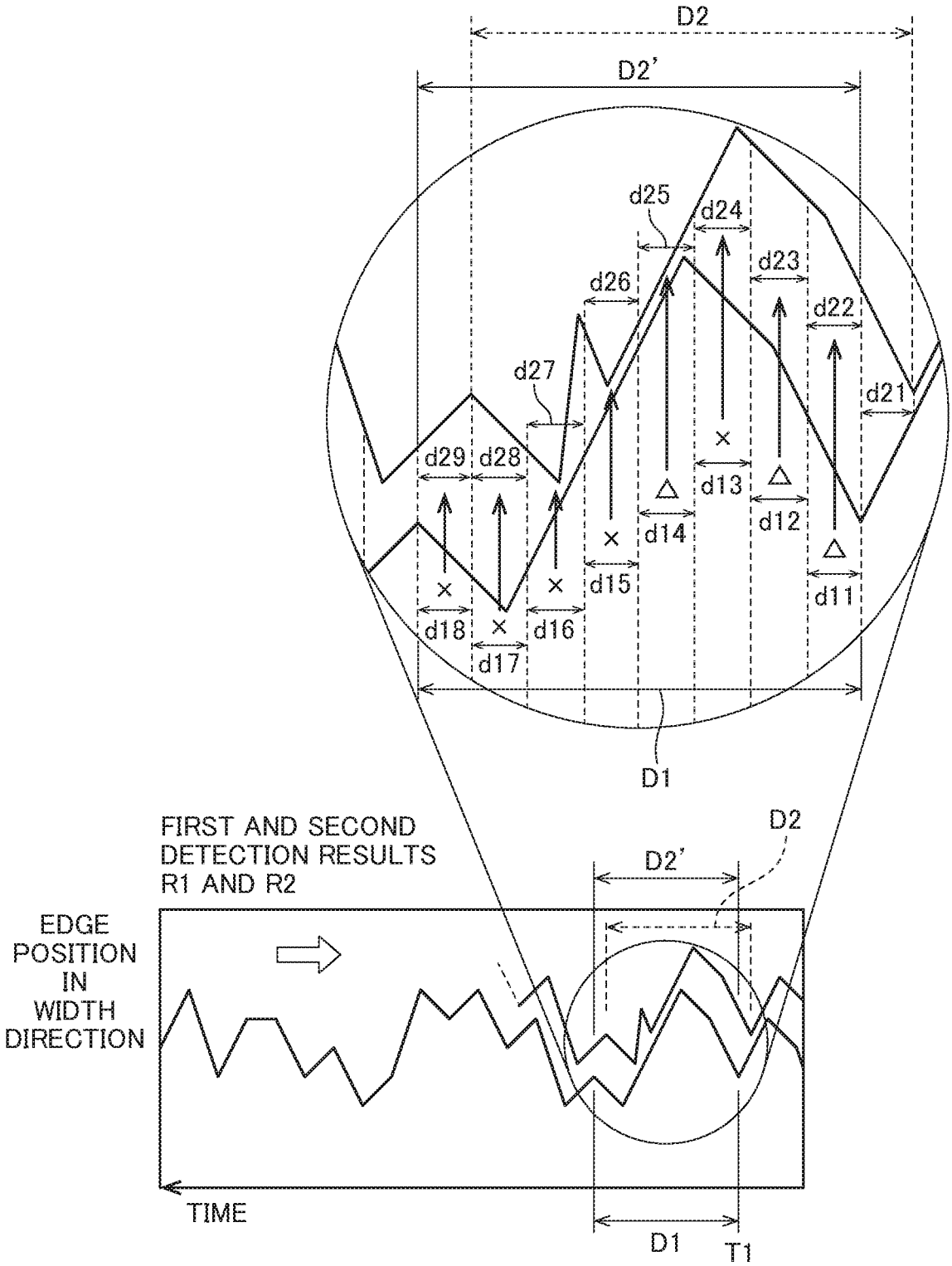
FIG. 8 is a graph obtained by overlaying the example of the first detection result and the example of the second detection result according to the first embodiment.

FIG. 8 is a graph obtained by overlaying the example of the first detection result R1 and the example of the second detection result R2. In FIG. 8, the graph of the second detection result R2 in FIG. 7 is superimposed and displayed on the graph of the first detection result R1 after having been moved by an amount corresponding to one downstream sub-data section in the direction indicated by an open arrow. After the degree of matching between one of the upstream sub-data sections d11 to d18 and one of the downstream sub-data sections d21 to d28 has been calculated sequentially as illustrated in FIG. 7, the displacement amount calculation part 41 shifts the downstream data section (downstream data section that becomes a candidate) D2 for which the evaluation value indicating the degree of matching with the upstream data section D1 is to be calculated, as illustrated in FIG. 8 (hereinafter, a downstream data section that is obtained by shifting the downstream data section D2 and for which the evaluation value indicating the degree of matching with the upstream data section D1 is to be calculated is referred to as a "downstream data section D2'"). Then, as in steps S1 to S3 described above, the displacement amount calculation part 41 according to the present embodiment sequentially calculates the degree of matching between one of the upstream sub-data sections d11 to d18 and one of downstream sub-data sections d22 to d29 included in the downstream data section D2'. Then, as in step S4 described above, the displacement amount calculation part 41 calculates an evaluation value that indicates the degree of matching between the upstream data section D1 and the downstream data section D2' on the basis of the results of calculation of the degree of matching between the sub-data sections.

In this way, for each upstream data section D1, the displacement amount calculation part 41 repeatedly calculates the evaluation value while shifting the downstream data section D2 that becomes a candidate. When the calculation of evaluation values between one upstream data section D1 and all the downstream data sections D2 that become candidates has been completed in due course (yes in step S5), the displacement amount calculation part 41 identifies a downstream data section D2 having a highest evaluation value as the downstream data section D2 that corresponds to (that is highly matched with) the upstream data section D1 (step S6).

Figure 9:
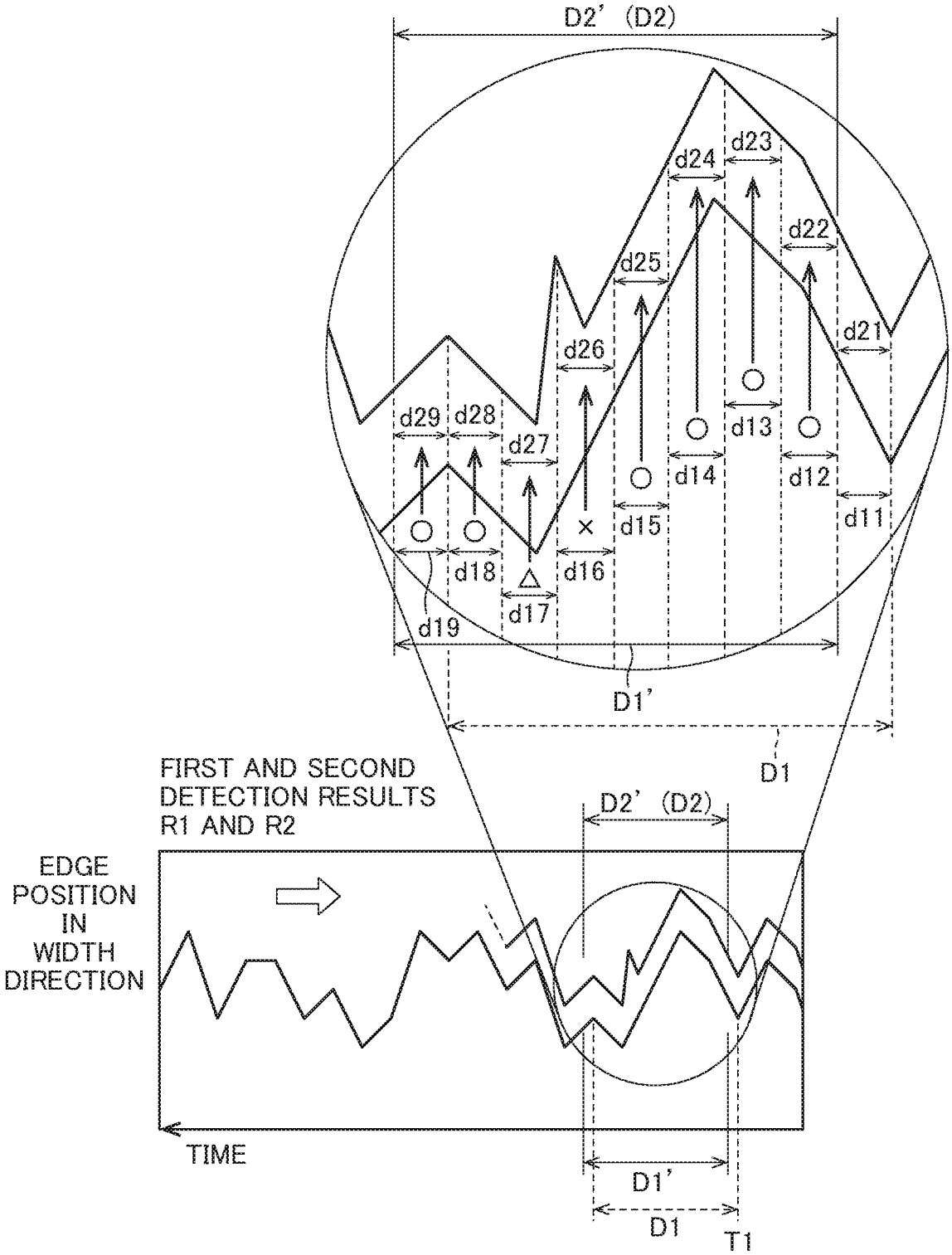
FIG. 9 is a graph obtained by overlaying the example of the first detection result and the example of the second detection result according to the first embodiment.

FIG. 9 is a graph obtained by overlaying the result of the first detection result R1 and the result of the second detection result R2. An enlarged view in FIG. 9 displays the enlarge view in FIG. 7 by moving the position of the enlarge view in FIG. 7 by an amount corresponding to one upstream or downstream sub-data section in the opposite direction to the open arrow. As illustrated in FIG. 9, when the downstream data section D2 corresponding to one upstream data section D1 has been identified, then the displacement amount calculation part 41 shifts the upstream data section D1 to be evaluated (hereinafter, an upstream data section that is to be evaluated after the shift of the upstream data section D1 is referred to as an "upstream data section D1'"). Specifically, the upstream data section D1 to be evaluated is chanted into a section (new upstream data section D1') that is delayed by an amount corresponding to one upstream sub-data section. Then, the aforementioned processing in steps S1 to S6 is performed again. Thereby, the displacement amount calculation part 41 identifies a downstream data section D2 that corresponds to the new upstream data section D1'.

In this case, among eight upstream sub-data sections d12 to d19 included in the new upstream data section D1', seven upstream sub-data sections d12 to d18 are "redundant sub-data sections" that are included redundantly in the previous upstream data section D1. Also, among the eight upstream sub-data sections d12 to d19 included in the new upstream data section D1', the latest downstream sub-data section d19 is a "nonredundant sub-data section" that is not included in the previous upstream data section D1. In the case of calculating the evaluation value indicating the degree of matching between the new upstream data section D1' and the downstream data section D2, for the calculation of the redundant sub-data sections, the displacement amount calculation part 41 reuses the calculation results of the degrees of matching between the upstream sub-data sections d12 to d18 and the downstream sub-data sections (d22 to d28), used to calculate the evaluation value indicating the degree of matching between the previous upstream data section D1 and the downstream data section D2. For the calculation of the nonredundant sub-data section, the displacement amount calculation part 41 newly calculates the degree of matching between the upstream sub-data section d19 and the downstream sub-data section (d29).

This further reduces the amount of computation performed by the displacement amount calculation part 41. As a result, as will be described later, it is possible to detect the amount of displacement of the printing paper 9 in the transport direction more quickly and to correct the timing of ejection of ink droplets from the four recording heads 21 to 24 more quickly on the basis of the detected amount of displacement.

In this way, the displacement amount calculation part 41 evaluates the degree of matching between the upstream data section D1 and the downstream data section D2 while shifting the upstream data section D1 by an amount corresponding to nonredundant sub-data sections (in the present embodiment one upstream sub-data section). Thereby, the displacement amount calculation part 41 identifies a highly matched downstream data section D2 for each upstream data section D1.

Note that the number of redundant sub-data sections and the number of nonredundant sub-data sections in one upstream data section D1 each may be at least one or more and within a range that does not exceed the total number of upstream sub-data sections included in one upstream data section D1. It is, however, noted that a plurality of upstream data sections D1 includes the same number of redundant sub-data sections. Also, a plurality of upstream data sections D1 includes the same number of nonredundant sub-data sections.

The length of the printing paper 9 in the transport direction that corresponds to one upstream data section D1 and the length of the printing paper 9 in the transport direction that corresponds to one downstream data section D2 are each desirably equal to the outer perimeter (e.g., 200 millimeters) of at least one of the plurality of rollers included in the transport mechanism 10. Here, the shape of the outer surface of the rollers may not be a perfect circle for manufacturing reasons or due to aged deterioration, for example. In this case, the first detection result R1 and the second detection result R2 include noise having a cycle that corresponds to the outer perimeter of the rollers. However, the influence of that noise on print quality is very small and neglectable. Besides, it is difficult to correct a slight amount of displacement of the printing paper 9 in the transport direction caused by that noise, even if that amount could be detected. As described above, if the length of the printing paper 9 in the transport direction that corresponds to the upstream data section D1 or the downstream data section D2 is made equal to the outer perimeter of the rollers, it is possible to cancel out the noise included in the first detection result R1 and the noise included in the second detection result R2 in the case of calculating the evaluation value indicating the degree of matching between the upstream data section D1 and the corresponding downstream data section D2. As a result, the evaluation value indicating the degree of matching between the upstream data section D1 and the corresponding downstream data section D2 can be calculated with higher accuracy. Also, processing loads on the controller 40 can be reduced by excluding that noise from the correction targets.

In the case where the rollers included in the transport mechanism 10 have different outer perimeters, the length of the printing paper 9 in the transport direction that corresponds to one upstream data section D1 and the length of the printing paper 9 in the transport direction that corresponds to one downstream data section D2 each may be made equal to the outer perimeter of the roller that is closest to the first edge sensor 31 or the second edge sensor 32 among the plurality of rollers included in the transport mechanism 10. Alternatively, the length of the printing paper 9 in the transport direction that corresponds to one upstream data section D1 and the length of the printing paper 9 in the transport direction that corresponds to one downstream data section D2 each may be made equal to the outer perimeter of the roller that is closest to the image recording part 20 among the plurality of rollers included in the transport mechanism 10. As another alternative, the length of the printing paper 9 in the transport direction that corresponds to one upstream data section D1 and the length of the printing paper 9 in the transport direction that corresponds to one downstream data section D2 each may be an integral multiple of the outer perimeter of at least one of the plurality of rollers included in the transport mechanism 10.

Thereafter, on the basis of a time difference between the detection time of the upstream data section D1 (time T1 in FIG. 5A) and the detection time of the downstream data section D2 that is most highly matched with the upstream data section D1 (time T2 in FIG. 5B), the displacement amount calculation part 41 calculates an actual transport time ΔT (time difference between time T2 and time T1) required to transport the printing paper 9 from the upstream detection position Pa to the downstream detection position Pb. The displacement amount calculation part 41 also calculates an actual transport speed of the printing paper 9 travelling under the image recording part 20 from the calculated transport time ΔT. The actual transport speed can be calculated by dividing the distance from the upstream detection position Pa to the downstream detection position Pb by the transport time ΔT.

Then, the displacement amount calculation part 41 calculates the times at which each portion of the printing paper 9 actually arrives at the first, second, third, and fourth processing positions P1, P2, P3, and P4, on the basis of the calculated actual transport speed. Thereby, the displacement amount calculation part 41 calculates the amounts of displacement of the printing paper 9 in the transport direction from the position of the printing paper 9 that is transported at the ideal transport speed. Note that the times at which each portion of the printing paper 9 actually arrives at the first, second, third, and fourth processing positions P1, P2, P3, and P4 can be calculated by dividing the distance from the upstream detection position Pa to each of the first, second, third, and fourth processing positions P1, P2, P3, and P4 by the actual transport speed. Also, the amount of displacement of the printing paper 9 in the transport direction can be calculated by multiplying a difference between the actual arrival time of the printing paper 9 at each of a plurality of locations including the first, second, third, and fourth processing positions P1, P2, P3, and P4 and the assumed arrival time thereof when the printing paper 9 is transported at the ideal transport speed, by the actual transport speed.

Note that other methods may be used to calculate the amounts of displacement of the printing paper 9 in the transport direction at the first, second, third, and fourth processing positions P1, P2, P3, and P4. For example, the amount of displacement of the printing paper 9 in the transport direction at the downstream detection position Pb may be calculated by multiplying a difference between the actual arrival time of the printing paper 9 at the downstream detection position Pb and the assumed arrival time thereof when the printing paper 9 is transported at the ideal transport speed, by the actual transport speed. Then, the amounts of displacement of the printing paper 9 in the transport direction at the first, second, third, and fourth processing positions P1, P2, P3, and P4 may be calculated by allocating portions of (or dividing) the amount of displacement of the printing paper 9 in the transport direction at the downstream detection position Pb according to the positional relationship of the processing positions P1 to P4, the upstream detection position Pa, and the downstream detection position Pb. For example, in the case where the six positions in total, including the four processing positions P1 to P4 and the two detection positions Pa and Pb, are aligned at equal intervals, the amount of displacement of the printing paper 9 in the transport direction at the fourth processing position P4, which is closest to the downstream detection position Pb, can be estimated to be a value obtained by multiplying the amount of displacement of the printing paper 9 in the transport direction at the downstream detection position Pb by four fifth.

Moreover, for example in the case where the downstream detection position Pb is located extremely close to the fourth processing position P4, the amount of displacement at the fourth processing position P4 may be regarded as the same as the amount of displacement of the printing paper 9 in the transport direction at the downstream detection position Pb.

In this way, the image recording apparatus 1 according to the present embodiment detects the shape of the edge 91 of the printing paper 9 at the two positions, namely the upstream detection position Pa and the downstream detection position Pb, and calculates the amount of displacement of the printing paper 9 in the transport direction on the basis of detection results. Thus, the amount of displacement of the printing paper 9 in the transport direction can be detected without depending on images such as register marks formed on the surface of the printing paper 9.

In particular, according to the present embodiment, the recording heads 21 to 24 of the image recording part 20 that are located between the upstream detection position Pa and the downstream detection position Pb eject ink droplets onto the surface of the printing paper 9. Thus, even if the length of the printing paper 9 in the transport direction is locally elongated due to adhesion of ink, the amount of displacement in the transport direction caused by this elongation can be calculated from the detection results obtained at the upstream detection positon Pa and the downstream detection position Pb.

The description returns to FIG. 4. The ejection correction part 42 corrects the timing of ejection of ink droplets from each of the recording heads 21 to 24 on the basis of the amount of displacement of the printing paper 9 in the transport direction, calculated by the displacement amount calculation part 41. For example, in the case where the time at which an image recording portion of the printing paper 9 arrives at each of the processing positions P1 to P4 lags behind the ideal time, the ejection correction part 42 delays the timing of ejection of ink droplets from each of the recording heads 21 to 24. Also, in the case where the time at which an image recording portion of the printing paper 9 arrives at each of the processing positions P1 to P4 is earlier than the ideal time, the ejection correction part 42 advances the timing of ejection of ink droplets from each of the recording heads 21 to 24. Note that the amount of correction by which the timing of ejection of ink droplets is corrected may be calculated by, for example, dividing the amount of displacement of the printing paper 9 at each of the processing positions P1 to P4 by the actual transport speed of the printing paper 9.

The print instruction part 43 controls operations of ejecting ink droplets from each of the recording heads 21 to 24 on the basis of received image data I. At this time, the print instruction part 43 references the amount of correction of the ejection timing that is output from the ejection correction part 42. Then, the print instruction part 53 shifts the original timing of ejection based on the image data I in accordance with the amount of correction. This allows ink droplets of each color to be ejected in appropriate locations in the transport direction on the printing paper 9 at each of the processing positions P1 to P4. Accordingly, mutual misregistration of the single-color images formed by each color ink can be suppressed. As a result, it is possible to obtain a high-quality print image with less mutual misregistration of the single-color images.

2. Variations

While an exemplary embodiment of the present invention has been described thus far, the present invention is not intended to be limited to the embodiment described above.

In the above-described embodiment, in the case of calculating the degree of matching with a downstream data section D2 included in the second detection result R2 for each upstream data section D1 included in the first detection result R1, the displacement amount calculation part 41 "divides" the upstream data section D1 into the plurality of upstream sub-data sections d11 to d18 that have the same time span. The displacement amount calculation part 41 also "divides" the downstream data section D2, which is one of the candidates for the data section corresponding to the upstream data section D1, into the plurality of downstream sub-data sections d21 to d28 that have the same time span. However, the displacement amount calculation part 41 may calculate the degree of matching between these sections D1 and D2 by determining a collection of a predetermined number of small data sections (upstream sub-data sections) that are included in the first detection result R1 and have the same time span as the upstream data section D1 and determining a collection of a predetermined number of small data sections (downstream sub-data sections) that are included in the second detection result R2 and have the same time span as the downstream data section D2. In either case, the concept is substantially the same, and the present invention includes both of the cases.

In the above-described embodiment, the upstream sub-data sections d11 to d18 included in the upstream data section D1 are adjacent to and contiguous with one another. However, the upstream sub-data sections d11 to d18 in the upstream data section D1 do not necessarily have to be adjacent to and continuous with one another. Also, the upstream sub-data sections d11 to d18 may be data sections that are selected at equal intervals and intermittently from the upstream data section D1, or may be data sections that overlap with one another. In the above-described embodiment, the downstream sub-data sections d21 to d28 included in the downstream data section D2 are adjacent to and continuous with one another. However, the downstream sub-data sections d21 to d28 in the downstream data section D2 do not necessarily have to be adjacent to and continuous with one another. Also, the downstream sub-data sections d21 to d28 may be data sections that are selected at equal intervals and intermittently from the downstream data section D2, or may be data sections that overlap with one another.

In the above-described embodiment, the ejection correction part 42 corrects the timing of ejection of ink droplets from each of the recording heads 21 to 24 on the basis of the amount of displacement of the printing paper 9 in the transport direction, calculated by the displacement amount calculation part 41. However, it is also possible to additionally provide a transport correction part that corrects the amount of displacement of the printing paper 9 in the transport direction by, instead of correcting the timing of ejection of ink droplets, correcting drive of at least one of the plurality of rollers on the basis of the amount of displacement of the printing paper 9 in the transport direction, calculated by the displacement amount calculation part 41. For example, in the case where the time at which an image recording portion of the printing paper 9 arrives at each of the processing positions P1 to P4 lags behind the ideal time, the transport collection part adjusts the number of revolutions of the rollers so as to change and increase the transport speed of the printing paper 9. This enables a correction to be made such that ink droplets of each color are ejected in appropriate locations in the transport direction on the printing paper 9.

In the above-described embodiment, the ejection correction part 42 corrects the timing of ejection of ink droplets from the recording heads 21 to 24 without correcting the received image data I itself. However, the ejection correction part 42 may correct the image data I on the basis of the amount of displacement of the printing paper 9 in the transport direction, calculated by the displacement amount calculation part 41. In that case, the print instruction part 43 only needs to instruct each of the recording heads 21 to 24 to eject ink droplets in accordance with the corrected image data I.

In FIG. 2 described above, the nozzles 201 of each of the recording heads 21 to 24 are arranged in a single line in the width direction. However, the nozzles 201 of each of the recording heads 21 to 24 may be arranged in two or more lines.

Figure 10:
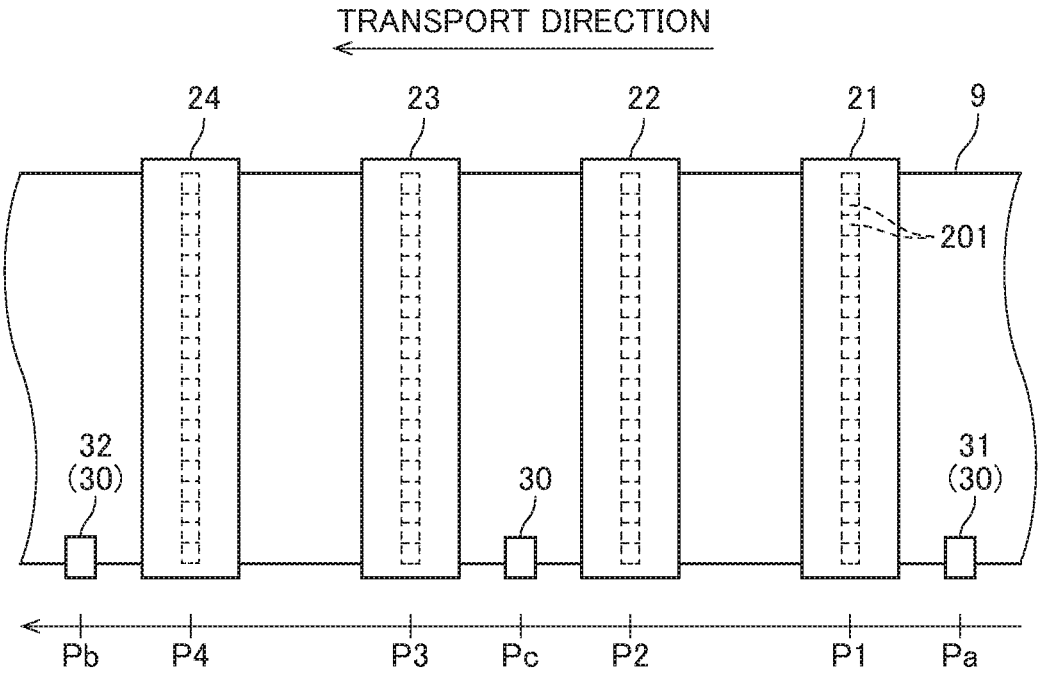
FIG. 10 is a partial top view of an image recording apparatus in the proximity of an image recording part according to a variation.

In the above-described embodiment, the edge sensors 30 are disposed at only the two positions, namely the upstream detection position Pa and the downstream detection position Pb. However, the number of edge sensors 30 disposed in the transport path of the printing paper 9 may be three or more. For example, as illustrated in FIG. 10, edge sensors 30 may be disposed at three positions in the transport path, including the upstream detection position Pa located upstream of the first processing position P1, an intermediate detection position Pc located between the second and third processing positions P2 and P3, and the downstream detection position Pb located downstream of the fourth processing position P4. In this case, the amount of displacement of printing paper 9 in the transport direction can be calculated with higher accuracy on the basis of detection results obtained by the three edge sensors 30. For example, even if the amount of displacement of the printing paper 9 in the transport direction between the first and second processing positions P1 and P2 and the amount of displacement thereof between the third and fourth processing positions P3 and P4 are different due to a difference in the amount of ink adhesion, it is possible to properly detect the amount of displacement at each processing position.

The edge sensors may be provided at positions under the recording heads. For example, the edge sensors may be provided at positions under each of the four recording heads.

In the above-described embodiment, the edge sensors are provided on only one side in the width direction of the printing paper. However, the edge sensors may be provided on both sides in the width direction of the printing paper. In this case, the amount of displacement of the printing paper in the transport direction can be detected on the basis of detection results of the edges on both sides in the width direction of the printing paper. This further improves the accuracy of detecting the amount of displacement.

The image recording apparatus according to the above-described embodiment calculates the transport speed of the printing paper on the basis of the signals obtained from the edge sensors and calculate the amount of displacement of the printing paper in the transport direction on the basis of the calculated transport speed. However, the image recording apparatus may correct the timing of ejection of ink droplets from the recording heads or correct the drive of the rollers on the basis of the amount of difference in the transport speed of the printing paper. That is, it is sufficient for the displacement amount calculation part to be configured to calculate either the amount of displacement of the printing paper in the transport direction or the amount of difference in the transport speed of the printing paper.

The image recording apparatus may have the function of detecting and correcting the amount of displacement of the printing paper in the width direction on the basis of signals obtained from the first edge sensor (first detector) and the second edge sensor (second detector). The image recording apparatus may also have the function of detecting and correcting meandering motion of the printing paper, a change in the obliqueness of the printing paper, the travelling position of the printing paper, or a change in the dimension of the printing paper in the width direction on the basis of the amount of displacement of the printing paper in the width direction. This eliminates the need to separately provide an edge sensor that detects the amount of displacement of the printing paper in the transport direction and an edge sensor that detects the amount of displacement of the printing paper in the width direction. Accordingly, it is possible to reduce the number of parts of the image recording apparatus.

In the above-described embodiment, transmission edge sensors are used as the first and second detectors. However, the first detector and the second detector may use other detection methods. For example, reflection optical sensors or CCD cameras may be used. The first and second detectors may be configured to detect the position of the edge of the printing paper two-dimensionally in the transport direction and the width direction. The first and second detectors may perform the detection operation intermittently as in the above-described embodiment, or may perform the detection operation successively. Moreover, the first and second edge sensors included in the upstream edge sensor (upstream detector) according to the above-described third embodiment may perform the detection operation intermittently, or may perform the detection operation successively. Also, the third and fourth edge sensors included in the downstream edge sensor (downstream detector) according to the above-described third embodiment may perform the detection operation intermittently, or may perform the detection operation successively.

In the above-described embodiment, for example, a clock or counter that is provided separately from the image recording apparatus can be used to measure the transport time of the printing paper or the arrival time at each location. However, instead of using such a clock or counter, the transport time and the arrival time may be measured on the basis of signals received from rotary encoders connected to the rollers, which are rotationally driven at a constant rotation speed in the transport mechanism.

In the above-described embodiment, the image recording apparatus includes four recording heads. However, the number of recording heads in the image recording apparatus may be in the range of one to three or may be five or more. For example, another recording head that ejects ink of a special color may be provided, in addition to the recording heads that eject ink of K, C, M, and Y colors. Moreover, these recording heads do not necessarily have to be disposed at equal intervals.

The present invention does not intend to exclude the case of detecting the amount of displacement of the printing paper on the basis of reference images such as register marks formed on the surface of the printing paper. For example, detection results obtained using the reference images such as register marks and detection results of the edge obtained by the edge sensors as described above may be used in combination to detect the amount of displacement of the printing paper in the transport direction or the amount of difference in the transport speed of the printing paper.

The image recording apparatus described above is configured to record a multicolor image on printing paper by inkjet printing. However, the base material processing apparatus according to the present invention may be configured to use a method other than inkjet printing (e.g., electrophotography or exposure) to record a multicolor image on printing paper. Also, the image recording apparatus described above is configured to perform print processing on printing paper that is a base material. However, the base material processing apparatus according to the present invention may be configured to perform predetermined processing on a long band-like base material (e.g., a resin film or metal leaf) other than ordinary paper. That is, processing parts in the base material processing apparatus according to the present invention may be configured to process the base material at processing positions in the transport path.

Each component described in the embodiment and variations described above may be combined appropriately within a range that causes no contradictions.

While the invention has been shown and described in detail, the foregoing description is in all aspects illustrative and not restrictive. It is therefore to be understood that numerous modifications and variations can be devised without departing from the scope of the invention.

What is claimed is:

1. A base material processing apparatus comprising:

a transport mechanism that transports a long band-like base material in a longitudinal direction along a predetermined transport path;

a first detector that successively or intermittently detects a position of an edge of the base material in a width direction at an upstream detection position in the transport path to acquire a first detection result;

a second detector that successively or intermittently detects the position of the edge of the base material in the width direction at a downstream detection position located downstream of the upstream detection position in the transport path to acquire a second detection result; and a displacement amount calculation part that, for each of a plurality of upstream data sections that are data sections included in the first detection result, identifies a highly matched downstream data section from among a plurality of downstream data sections that are data sections included in the second detection result, and calculates an amount of displacement of the base material in a transport direction or an amount of difference in a transport speed of the base material on the basis of an identification result, wherein each of the plurality of upstream data sections includes a plurality of upstream sub-data sections, each of the plurality of downstream data sections includes a plurality of downstream sub-data sections, and the displacement amount calculation part uses at least one result obtained by sequentially calculating a degree of matching between one of the plurality of upstream sub-data sections and one of the plurality of downstream sub-data sections to identify the highly matched downstream data section for each of the plurality of upstream data sections.

2. The base material processing apparatus according to claim 1, wherein the displacement amount calculation part sequentially identifies the highly matched downstream data section for each of the plurality of upstream data sections, the plurality of upstream sub-data sections in each of the plurality of upstream data sections includes:

at least one redundant sub-data section that is included redundantly in a different one of the plurality of upstream data sections; and at least one nonredundant sub-data section that is not included in a different one of the plurality of upstream data sections, and in a case of calculating an evaluation value that indicates a degree of matching between each of the plurality of upstream data sections and each of the plurality of downstream data sections, the displacement amount calculation part uses a result of calculation of a degree of matching between the redundant sub-data section and a corresponding one of the plurality of downstream sub-data sections, the result having been used to calculate an evaluation value that indicates a degree of matching between the different one of the plurality of upstream data sections and the downstream data section.

3. The base material processing apparatus according to claim 1, wherein the displacement amount calculation part estimates a data section of the second detection result that corresponds to a data section included in the first detection result, and identifies a data section of the second detection result that is highly matched with the data section included in the first detection result from among data sections that are located in close proximity to the estimated data section.

4. The base material processing apparatus according to claim 1, wherein the base material processing apparatus further has a function of detecting an amount of displacement of the base material in the width direction on the basis of signals obtained by the first detector and the second detector.

5. The base material processing apparatus according to claim 1, wherein the transport mechanism includes a plurality of rollers, and a length of the base material in the transport direction that corresponds to one of the plurality of upstream data sections and a length of the base material in the transport direction that corresponds to one of the plurality of downstream data sections are each equal to an outer perimeter of at least one of the plurality of rollers.

6. The base material processing apparatus according to claim 5, wherein the length of the base material in the transport direction that corresponds to one of the plurality of upstream data sections and the length of the base material in the transport direction that corresponds to one of the plurality of downstream data sections are each equal to the outer perimeter of the plurality of rollers that is closest to the first detector or the second detector.

7. The base material processing apparatus according to claim 5, further comprising:

a processing part that is disposed at a processing position in the transport path and processes the base material, wherein the length of the base material in the transport direction that corresponds to one of the plurality of upstream data sections and the length of the base material in the transport direction that corresponds to one of the plurality of downstream data sections are each equal to the outer perimeter of one of the plurality of rollers that is closest to the processing part.

8. The base material processing apparatus according to claim 1, further comprising:

a processing part that is disposed at a processing position in the transport path and processes the base material, wherein the processing part is an image recording part that records an image by ejecting ink to a surface of the base material.

9. The base material processing apparatus according to claim 8, wherein the processing part ejects ink to the surface of the base material at a position located between the upstream detection position and the downstream detection position.

10. The base material processing apparatus according to claim 8, wherein the image recording part includes a plurality of recording heads arranged in the transport direction, and the plurality of recording heads ejects ink of different colors.

11. A detection method of detecting an amount of displacement of a long band-like base material in a transport direction or an amount of difference in a transport speed of the base material while transporting the base material in a longitudinal direction along a predetermined transport path, the detection method comprising:

a) successively or intermittently detecting a position of an edge of the base material in a width direction at an upstream detection position in the transport path to acquire a first detection result;

b) successively or intermittently detecting the position of the edge of the base material in the width direction at a downstream detection position located downstream of the upstream detection position in the transport path to acquire a second detection result; and c) for each of a plurality of upstream data sections that are data sections included in the first detection result, identifying a highly matched downstream data section from among a plurality of downstream data sections that are data sections included in the second detection result, and calculating the amount of displacement of the base material in the transport direction or the amount of difference in the transport speed of the base material on the basis of an identification result, wherein each of the plurality of upstream data sections includes a plurality of upstream sub-data sections, each of the plurality of downstream data sections includes a plurality of downstream sub-data sections, and in the operation c), at least one result obtained by sequentially calculating a degree of matching between one of the plurality of upstream sub-data sections and one of the plurality of downstream sub-data sections is used to identify the highly matched downstream data section for each of the plurality of upstream data sections.

12. The detection method according to claim 11, wherein in the operation c), the highly matched downstream data section is sequentially identified for each of the plurality of upstream data sections, the plurality of upstream sub-data sections in each of the plurality of upstream data sections includes:

at least one redundant sub-data section that is included redundantly in a different one of the plurality of upstream data sections; and at least one nonredundant sub-data section that is not included in a different one of the plurality of upstream data sections, and in a case of calculating an evaluation value that indicates a degree of matching between each of the plurality of upstream data sections and each of the plurality of downstream data sections, the operation c) uses a result of calculation of a degree of matching between the redundant sub-data section and a corresponding one of the plurality of downstream sub-data sections, the result having been used to calculate an evaluation value that indicates a degree of matching between the different one of the plurality of upstream data sections and the downstream data section.

13. The detection method according to claim 11, wherein in the operation c), a data section of the second detection result that corresponds to a data section included in the first detection result is estimated, and a data section of the second detection result that is highly matched with the data section included in the first detection result is identified from among data sections that are located in close proximity to the estimated data section.

14. The detection method according to claim 11, further comprising:

d) detecting an amount of displacement of the base material in the width direction on the basis of signals obtained in the operations a) and b).

15. The detection method according to claim 11, further comprising:

e) recording an image by ejecting ink to a surface of the base material at a processing position in the transport path.

16. The detection method according to claim 15, wherein in the operation e), ink is ejected to the surface of the base material at the processing position that is located between the upstream detection position and the downstream detection position.

* * * * *